US011634900B2

(12) United States Patent
Bell

(10) Patent No.: US 11,634,900 B2
(45) Date of Patent: Apr. 25, 2023

(54) CONCRETE BUILDING CONSTRUCTION USING SUPPORTED, FILLABLE STRUCTURES

(71) Applicant: Lab Bell LLC, New York, NY (US)

(72) Inventor: Alex Morgan Bell, New York, NY (US)

(73) Assignee: AUTOMATIC CONSTRUCTION INC., New York, NY (US)

( * ) Notice: Subject to any disclaimer, the term of this patent is extended or adjusted under 35 U.S.C. 154(b) by 0 days.

(21) Appl. No.: 17/166,842

(22) Filed: Feb. 3, 2021

(65) Prior Publication Data

US 2022/0243452 A1 Aug. 4, 2022

(51) Int. Cl.

| | |
|---|---|
| ***E04B 1/16*** | (2006.01) |
| ***E04B 1/76*** | (2006.01) |
| ***E04B 2/86*** | (2006.01) |
| ***E04B 7/22*** | (2006.01) |
| ***E04G 25/02*** | (2006.01) |
| ***E04B 5/32*** | (2006.01) |

(52) U.S. Cl.

CPC ..... *E04B 1/168* (2013.01); *E04B 1/165* (2013.01); *E04B 1/7608* (2013.01); *E04B 2/8664* (2013.01); *E04B 5/326* (2013.01); *E04B 7/22* (2013.01); *E04G 25/02* (2013.01); *E04B 2002/8688* (2013.01); *E04B 2103/02* (2013.01)

(58) Field of Classification Search

CPC ..... E04H 2015/201; E04H 2015/204; E04H 2015/202; E04H 2015/203; E04H 2015/205; E04H 2015/206; E04H 15/20; E04H 15/22; E04C 3/005; E04B 1/161; E04B 1/165; E04B 1/166; E04B 1/167; E04B 1/168; E04B 1/169; E04B 1/35; E04B 1/3505; E04B 1/3522; E04B 1/3527; E04B 1/3544; E04B 2001/3594

See application file for complete search history.

(56) References Cited

U.S. PATENT DOCUMENTS

| | | | |
|---|---|---|---|
| 972,961 | A | 10/1910 | Wedmore |
| 3,259,367 | A | 7/1966 | Squire |

(Continued)

FOREIGN PATENT DOCUMENTS

| | | | |
|---|---|---|---|
| DE | 3442904 | A1 | 6/1986 |
| EP | 2256252 | B1 | 6/2016 |
| GB | 2374625 | A | 10/2002 |

OTHER PUBLICATIONS

International Search Report and Written Opinion dated May 4, 2022 for International Patent Application No. PCT/US2022/013711.

*Primary Examiner* — Jessica L Laux

(74) *Attorney, Agent, or Firm* — AMPACC Law Group, PLLC

(57) ABSTRACT

A building structure assembly for use with constructing buildings (e.g., dwellings, offices, and so on) is described. In some embodiments, the building structure assembly includes a fillable container structure formed of a drop stitch fabric or material, and a removable shoring structure configured to position the container structure in a desired configuration when filled by building material, such as cement or concrete. In some cases, the container structure can include reinforcement components, which move into suitable positions when the container structure is filled with the building material.

20 Claims, 10 Drawing Sheets

(56) References Cited

U.S. PATENT DOCUMENTS

| | | | | |
|---|---|---|---|---|
| 3,425,228 | A | 2/1969 | Lamberton | |
| 3,619,432 | A | 11/1971 | Harrington | |
| 3,670,504 | A * | 6/1972 | Hayes | D03D 11/02 405/32 |
| 3,909,992 | A | 10/1975 | Stachiw | |
| 4,324,074 | A * | 4/1982 | South | E04B 1/3505 52/2.15 |
| 6,192,633 | B1 * | 2/2001 | Hilbert | E04H 1/1277 52/2.18 |
| 8,752,336 | B1 * | 6/2014 | Ozsuer | F41H 5/24 52/2.15 |
| 9,493,939 | B2 * | 11/2016 | South | E04H 15/20 |
| 9,499,970 | B2 * | 11/2016 | Milo | E04B 1/165 |
| 2008/0295445 | A1 | 12/2008 | James | |
| 2016/0024812 | A1 | 1/2016 | South | |
| 2016/0123012 | A1 | 5/2016 | Francies, III | |
| 2018/0071949 | A1 * | 3/2018 | Giles | B33Y 50/02 |
| 2019/0024361 | A1 * | 1/2019 | Keville | E04H 15/20 |

* cited by examiner

CONCRETE BUILDING CONSTRUCTION USING SUPPORTED, FILLABLE STRUCTURES

BACKGROUND

Many different technologies, such as inflatables and construction techniques, utilize drop stitch materials to maintain forms and shapes of structures during their use or formation. For example, inflatable kayaks and paddle boards are made of drop stitch materials that facilitate the creation of high pressure, rigid inflatable boat forms. Further, drop stitch materials have been utilized in processes for forming cement-based structures (e.g., cementitious structures), such as blast-prevention structures and reinforced concrete structures.

These and other technologies utilize drop stitch (or, drop-stitch) materials and forms because the materials maintain rigidity and strength under high pressure, such as pressure from the inflow of air or filling materials (e.g., cement or concrete). Drop stitch materials are generally woven plastic materials where two layers of woven fabric are connected via many periodic stitches that pass between and connect the layers together. A plastic coating layer is also applied to the connected layers, causing the layers to be impermeable to air.

While such materials have been utilized by certain technologies in forming rigid structures, such technologies still utilize the materials for limited or narrow processes. These and other drawbacks exist with respect to current uses of drop stitch materials.

BRIEF DESCRIPTION OF THE DRAWINGS

Embodiments of the present technology will be described and explained through the use of the accompanying drawings.

Figure 1:
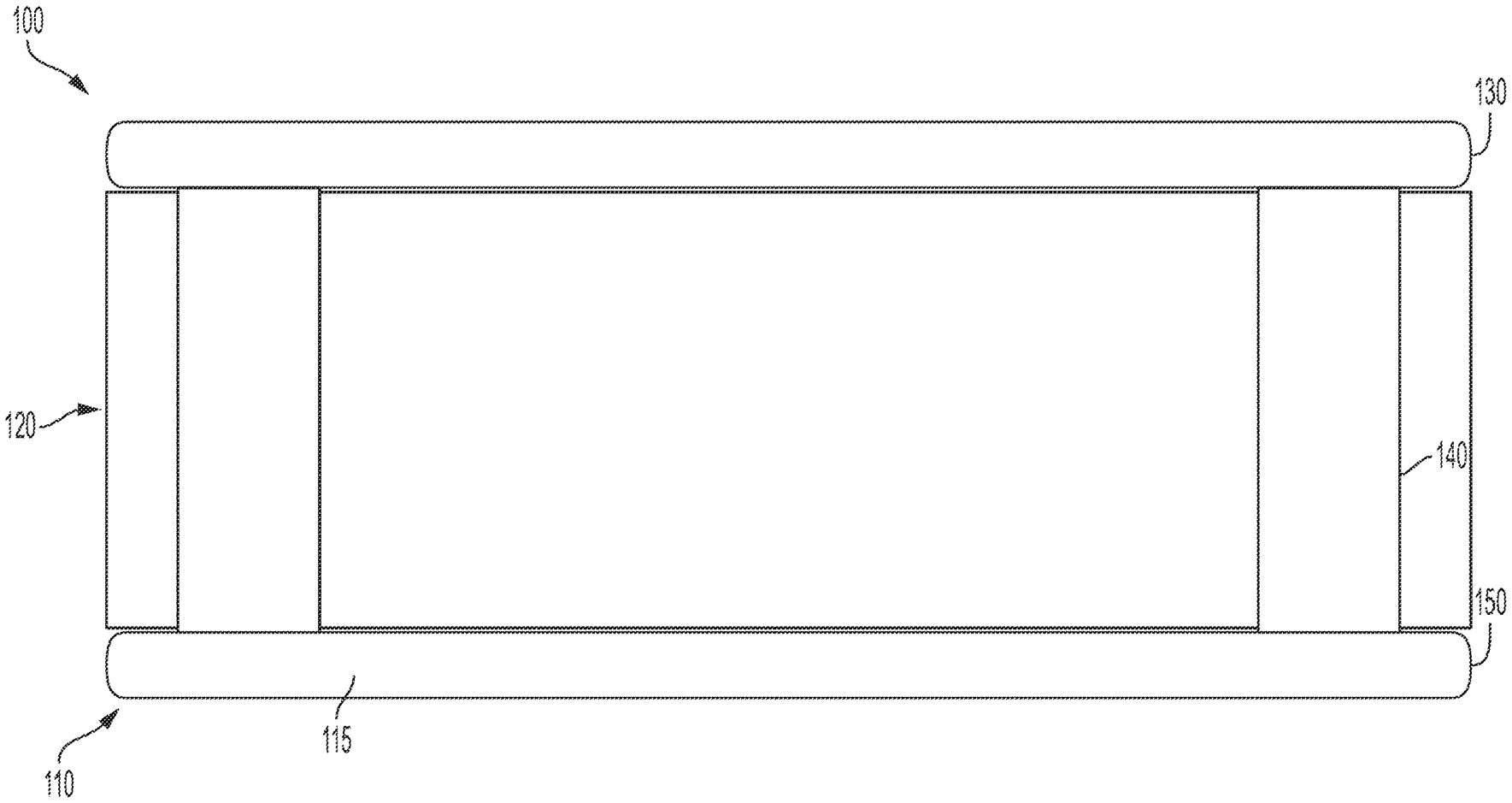
FIG. 1 is a diagram illustrating an example building structure assembly having a filled container structure and expanded shoring structure.

In the drawings, some components are not drawn to scale, and some components and/or operations can be separated into different blocks or combined into a single block for discussion of some of the implementations of the present technology. Moreover, while the technology is amenable to various modifications and alternative forms, specific implementations have been shown by way of example in the drawings and are described in detail below. The intention, however, is not to limit the technology to the particular implementations described. On the contrary, the technology is intended to cover all modifications, equivalents, and alternatives falling within the scope of the technology as defined by the appended claims.

DETAILED DESCRIPTION

Overview

A building structure assembly, system, and methods for constructing building structures are described herein. In some embodiments, the building structure assembly includes a fillable container structure and a shoring structure disposed to maintain the container structure in a certain configuration when the container structure is filled with a building material, such as cement or concrete.

In some cases, the container structure is formed of drop stitch fabrics or materials, such as layered plastic materials, that are woven together and maintain rigidity when filled with various materials, such as cementitious materials (e.g., cement, concrete, and so on) or other expandable materials that set or harden. Utilizing such materials, the building structure assembly can be placed in an erected or other vertical configuration via an associated inflatable shoring structure, and then filled with the desired building materials.

For example, the building structure assembly, or building assembly, can be used in constructing a building. The assembly can include a container structure having an expandable shape including a roof, multiple support posts, and a floor. The container structure is configured to be filled with a building material, and/or formed of a drop stitch material. The assembly also includes a removable shoring structure that supports the container structure and is disposed between the roof, the multiple support posts, and the floor. The shoring structure is configured to be inflated in order to support the container structure in the expandable shape when the container structure is filled with the building material.

As another example, the building structure assembly facilitates the building or erecting of a structure. Such a method or process can include positioning a building assembly at a building site, where the building assembly include a container structure having an expandable shape that is configured to be filled with a building material and a shoring structure that supports the container structure when the container structure is filled with the building material. Then, the process includes expanding the shoring structure to position the container structure in a desired shape, causing the shoring structure to be filled with the building material, and removing the shoring structure from the building assembly.

Thus, in some embodiments, the technology is based on an apparatus that includes (1) an expandable container formed of a drop stitch material and configured to be filled with a cementitious or other setting/hardening material (e.g., cement or concrete), and (2) an inflatable support structure configured to support at least a portion of the expandable container in a vertical or upwards direction when the expandable container is filled of the cementitious material.

Various embodiments of the building structure assembly and associated construction processes will now be described. The following description provides specific details for a thorough understanding and an enabling description of these embodiments. One skilled in the art will understand, however, that these embodiments may be practiced without many of these details. Additionally, some well-known structures or functions may not be shown or described in detail, so as to avoid unnecessarily obscuring the relevant description of the various embodiments. The terminology used in the description presented below is intended to be interpreted in its broadest reasonable manner, even though it is being used in conjunction with a detailed description of certain specific embodiments.

Examples of the Building Structure Assembly

As described herein, the technology utilizes drop stitch materials and fabrics when forming building structures, such as structural forms made of concrete or cement that are used when constructing buildings, such as homes, dwellings, floors of multi-story office buildings or residences, and so on. Unlike previous uses of drop stitch fabrics, the building structure assemblies (or simply building assemblies) described herein enable the formation of vertical structures and features while utilizing drop stitch materials. For example, the vertical structured can include structures having roofs or ceilings supported by posts, pillars, or walls.

FIG. 1 is a diagram illustrating an example building structure assembly 100 having a filled container structure 110 and expanded shoring structure 120. As depicted, the container structure 110 is filled with a cementitious material 115, such as cement or concrete, after positioned in place by the expanded shoring structure 120. The shoring structure 120, which is inflated by air or another suitable gas (e.g., Nitrogen or some mix of gases), is positioned between different portions of the container structure 110. In the expanded state, the container structure 110 includes a roof or ceiling 130, multiple support posts or walls 140, and a floor or base 150. The container structure 110 can be configured as a single fillable structure, or as multiple fillable structures (e.g., where the roof 130, posts 140, and/or floor 150 are separate structured from one another).

In some cases, the building structure assembly 100 can be utilized with other setting or hardening materials, such as polyurethane or plastic foams that can expand and harden within the container structure 110.

Figure 2:
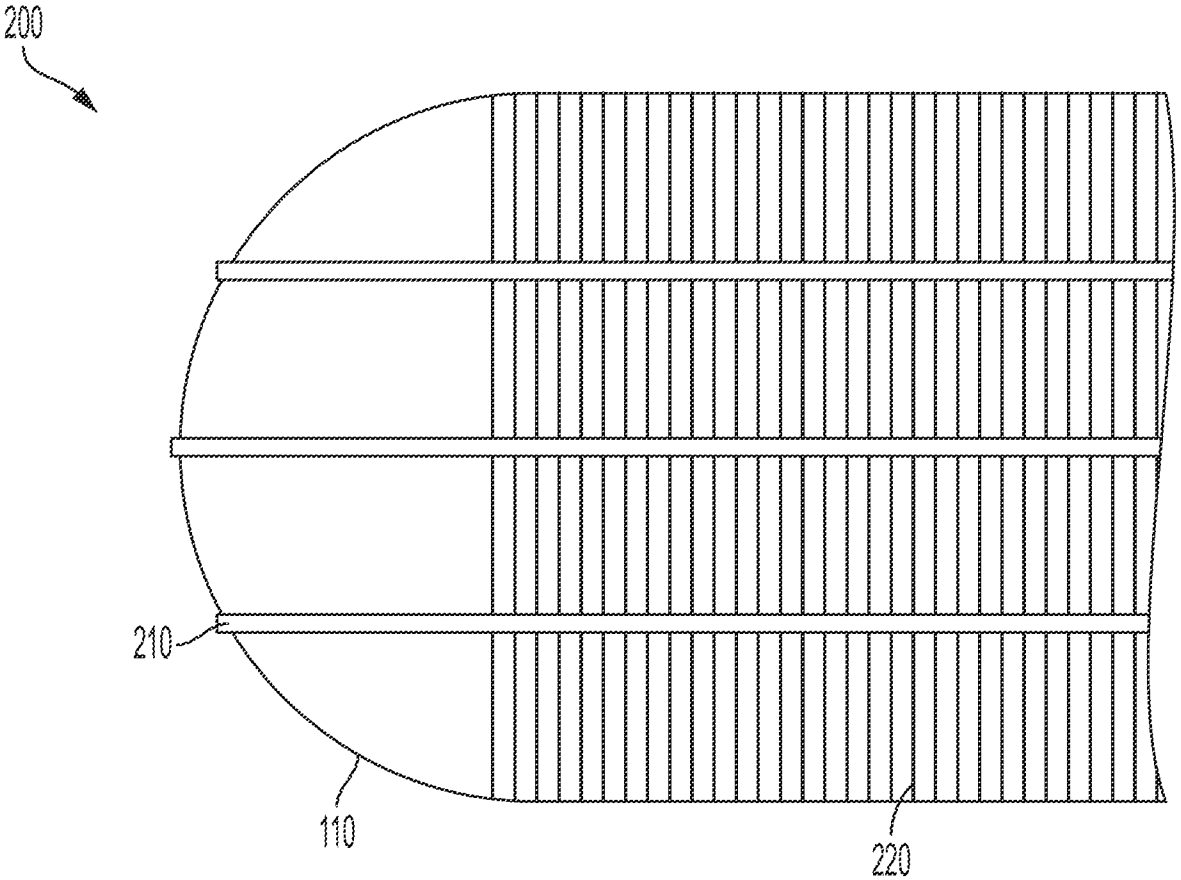
FIG. 2 is a diagram illustrating an example container structure having reinforcement components.

As described herein, the container structure 110 can include various reinforcement components, in addition to the many threads or fibers of the drop stitch fabric that forms the container structure 110. FIG. 2 is a diagram illustrating an example container structure 200 having reinforcement components.

The container structure 200 includes reinforcement components 210, such as reinforcing cables, rebar, and/or other structural reinforcement components. The reinforcement components 210, as depicted, are disposed throughout the container structure 200, extending through and partially out of sides of the container structure 200. In some cases, the reinforcement components 210 are disposed through a longer portion of the container structure 200, and cross drop stitch fibers 220, which are disposed and fixed (e.g., under tension when the structure 200 is filled) along a shorter portion of the structure 200.

Figure 3:
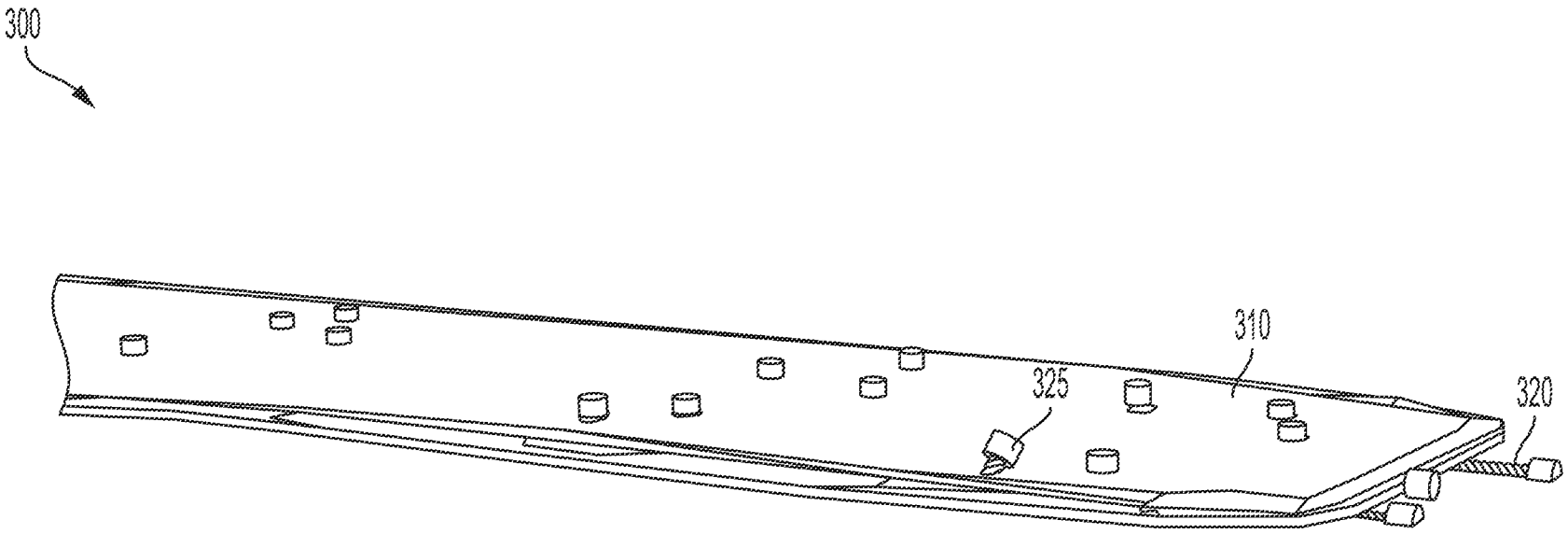
FIG. 3 is a diagram illustrating an unfilled container structure of the building structure assembly.

However, in other cases, the reinforcement components 210 and/or the drop stitch fibers 220 can be disposed and/or placed in either directions. For example, as is depicted in FIG. 3, a container structure 300, or sections of the structure, can include cables that cross and extend in both vertical and horizontal directions.

As shown, the container structure 300 includes an unfilled drop stitch material 310 that, when filled with material, maintains a desired shape of a building structure. Further, the container structure 300 includes reinforcing cables, such as reinforcing cables 320 that extend along a horizontal axis of the structure 300 and reinforcing cables 325 that extend along a vertical axis of the structure.

Figure 4:
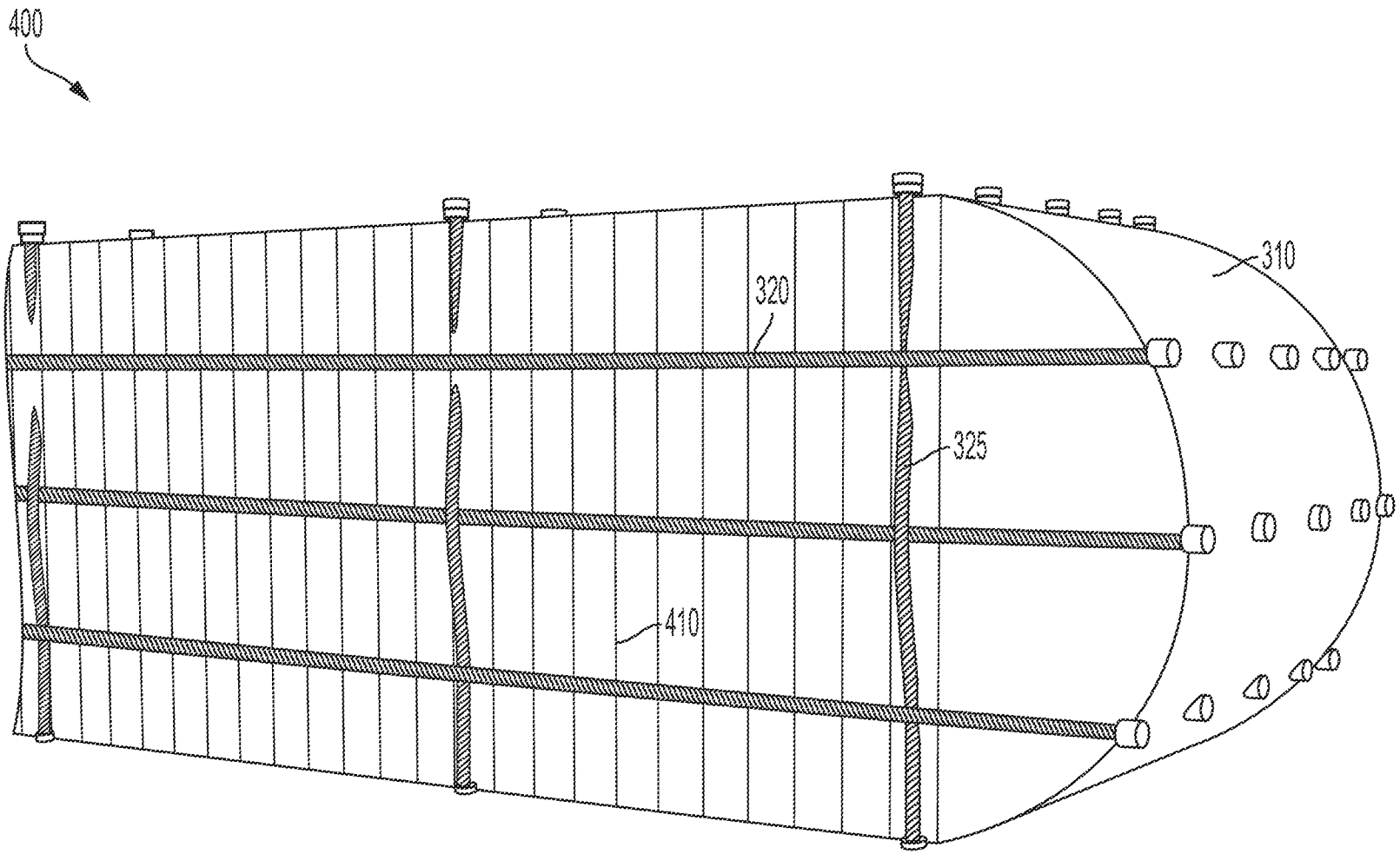
FIG. 4 is a diagram illustrating a filled container structure of the building structure assembly.

FIG. 4 depicts the container structure 300 being filled and expanded with filling material, such as cement or concrete. The filled structure 400, as shown, includes the horizontal reinforcing cables 320, which extend lengthwise from a side of the structure 400, through the structure 400, to another side of the structure 400. Further, the filled structure 400 includes the vertical reinforcing cables 325, which extend vertically from a bottom of the structure 300, through the structure 300, to a top of the structure 300. Thus, the reinforcement components move into a fixed configuration when the container structure is filled with the building material.

As shown, in some cases, the reinforcing cables 320, 325 are positioned partially within the drop stitch fabric 310, providing additional support to the structure 400 at edges of the structure 400. Thus, drop stitch material 310, having tensioned fibers 410, creates a strong, rigid form that is reinforced by the reinforcing cables 320, 325 when filled with building material.

Figure 5:
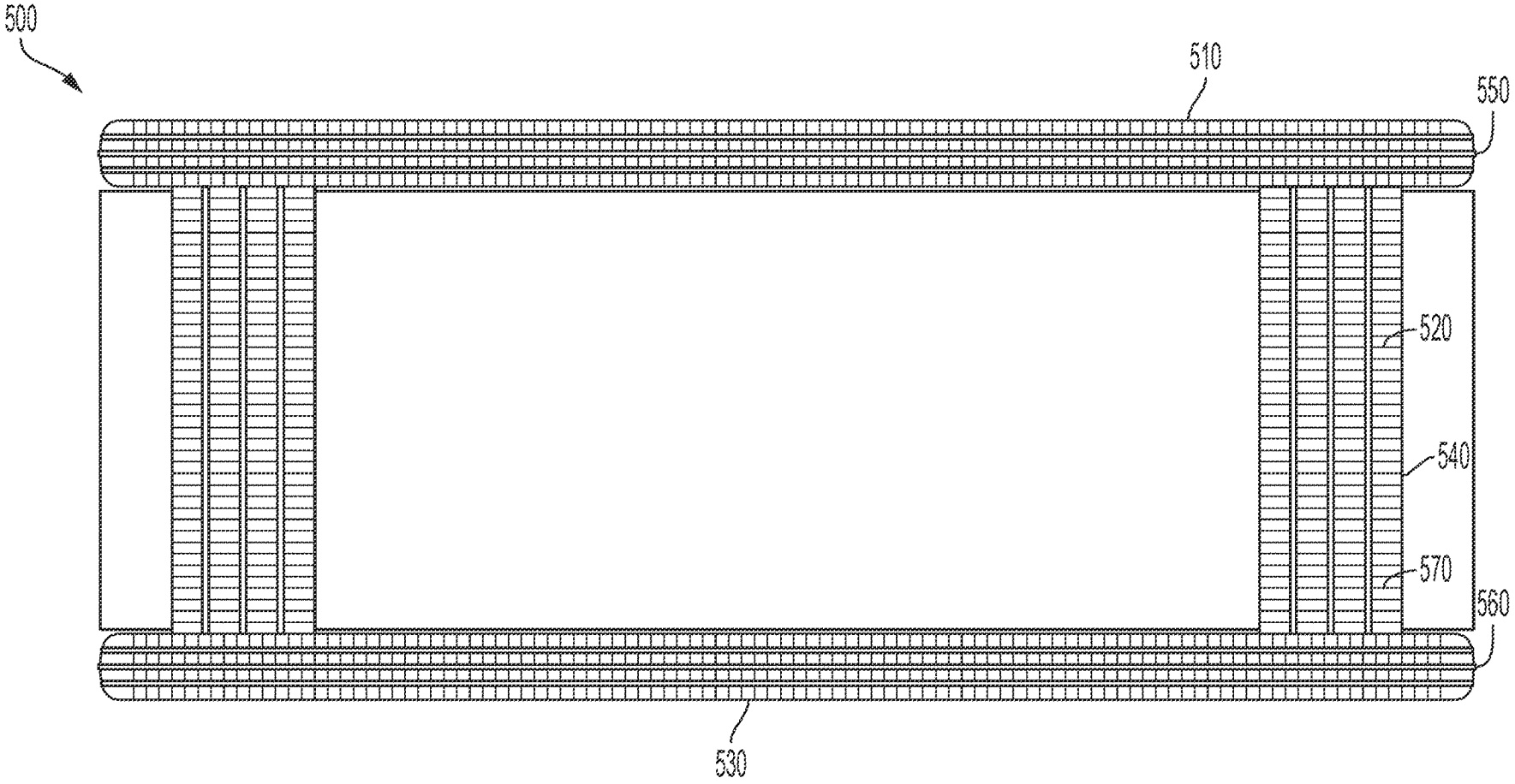
FIG. 5 is a diagram illustrating an example structure formed via the building structure assembly.

Thus, as described herein, the building assembly can be utilized to form various building structures or shapes, including shapes traditionally utilized during construction of buildings, such as homes, offices, towers, warehouses, and so on. For example, the building assembly may provide a structure utilized during the construction of modular homes and other buildings. FIG. 5 is a diagram illustrating an example structure 500 formed via the building structure assembly.

The structure 500 includes a roof 510, multiple walls 520, and a floor 530. The shape is created or formed by filling a container structure 540 with building material 550, such as cementitious material 550 (e.g., concrete, cement, and so on). The container structure 540 includes drop stitch material having tensioned fibers 570, and may include, disposed within an inside portion of the structure 540, one or more reinforcement components 560.

The shape of the structure 500 can take on a variety of configurations, depending on the design of the container structure 540. For example, the structure 500 can be rectangular, as depicted, or may include cylindrical walls or support posts. Further, the structure 500 can include three or more walls, including configurations that include internal walls or posts, as well as various angled walls or roofs.

While not shown in the Figures, the structure 500 can include other components that extend through the container structure 540 and are positioned or fixed when the container structure 540 is filled with building material. Example components include conduit, plumbing or other pipes or conduit, cables and associated routing, electrical or communication components, HVAC cables or ducts, and so on.

Figure 6:
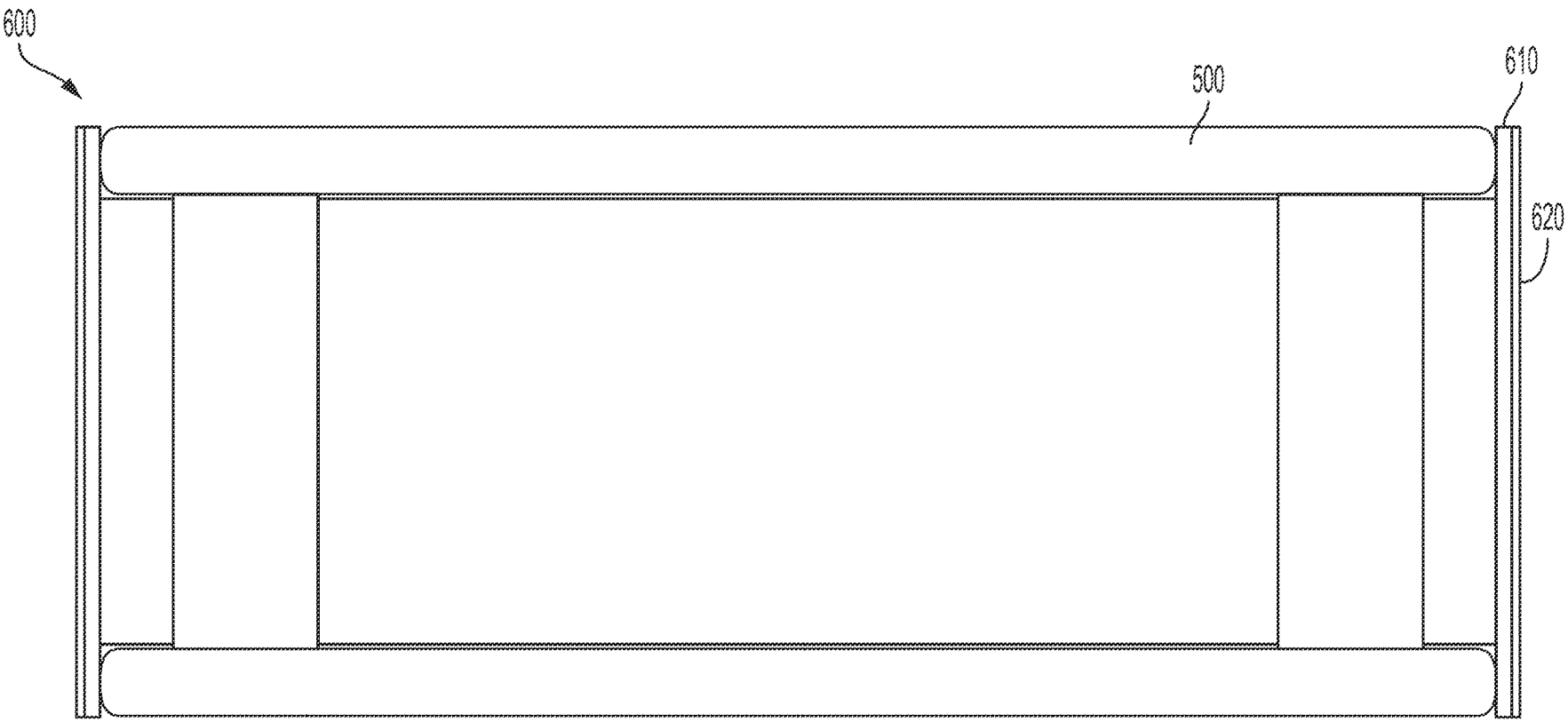
FIG. 6 is a diagram illustrating another example structure formed via the building structure assembly.

In addition to the shape of a structure, the building assembly can facilitate the formation of structures having additional layers or components. FIG. 6 is a diagram illustrating a structure 600 having additional layers. The structure 600 includes a base structure, such as the structure 500, as well as one or more layers fixed, disposed on, or otherwise applied to the drop stitch material of the structure 500.

As depicted, the structure 600 includes an insulating layer 610 formed of a flexible insulating material. The insulating layer 600 can be applied to the drop stitch material of the structure 500 and takes shape when the structure 500 is filled and expanded. The insulating layer 610 can provide thermal insulation for the structure (or sections thereof).

In addition to the insulating layer 610, other layers can be applied to drop stitch material of the structure 500. Example layers include waterproofing layers or coatings, electrical layers or patterns, reflective coatings or layers, layers or coatings that facilitate the connection or coupling of two or more structures 500 (e.g., as applied to a bottom section of a floor portion and/or a top section of s roof portion), and so on.

Further, a façade or external layer 620 can also be applied to the structure 600. The façade or external layer 620 can act as an outer layer of the structure 600 and/or act as an outer, viewable surface (or section thereof) of a building or dwelling formed using the structure 600. Example materials can include vinyl and other plastics, paint or other expandable applied coatings, and so on.

Figure 7:
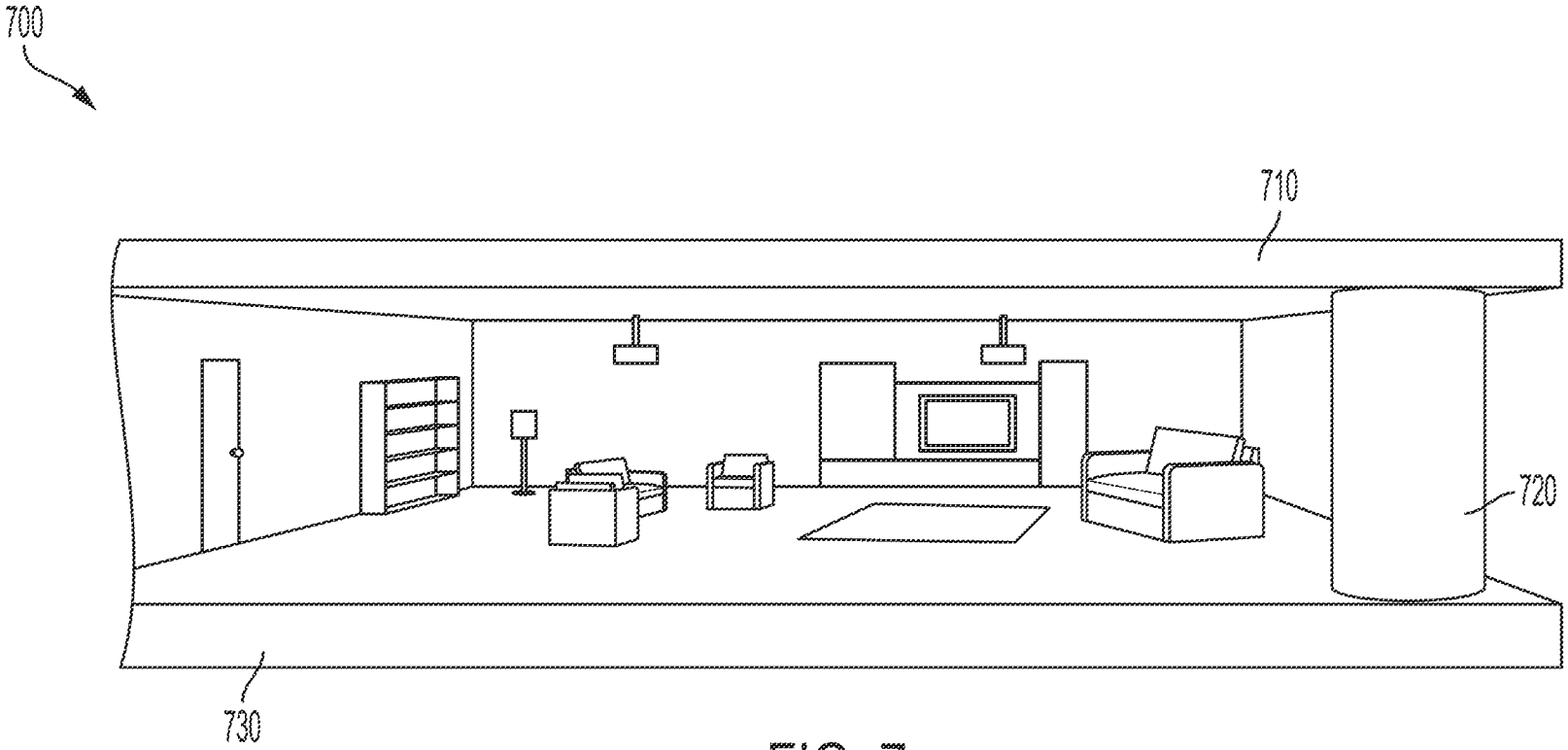
FIG. 7 is a diagram illustrating a building constructed using the building structure assembly.

As described herein, in some embodiments, the building assembly can be utilized to create a home or dwelling, such as a modular home. FIG. 7 is a diagram illustrating a building 700 constructed using the building structure assembly. The building 700 is formed of a large, single structure, and includes a roof 710 or ceiling, multiple support posts 720, and a floor 730. Other structures, such as walls, windows or glass partitions, and so on, can be added to the structure in order to configure or customize the design or layout of the building 700.

Figure 8:
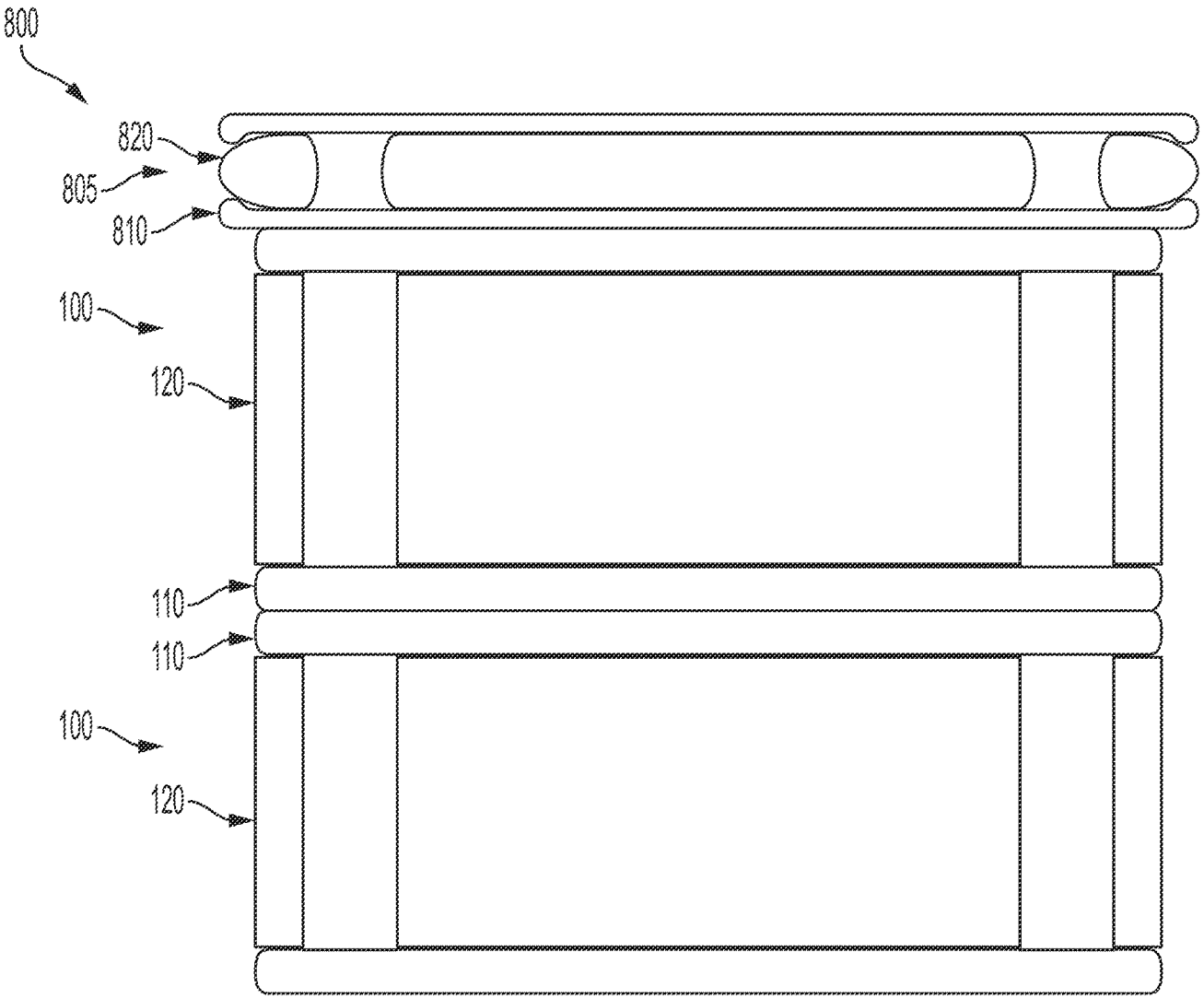
FIG. 8 is a diagram illustrating a multi-story building constructed using the building structure assembly.

FIG. 8 is a diagram illustrating the building of a multi-story building 800 constructed using the building structure assembly. As shown, the building includes multiple stories, each formed using the building assembly 100 (e.g., the filled container structure 110 and inflated shoring structure 120). The top story 805, as depicted, is not yet formed, with an unfilled container structure 810 being supported by an inflated shoring structure 820, awaiting filling (and hardening) of building material. Thus, as described herein, the building assemblies can be utilized to create single story structures, multi-story structures, and so on.

Figure 9:
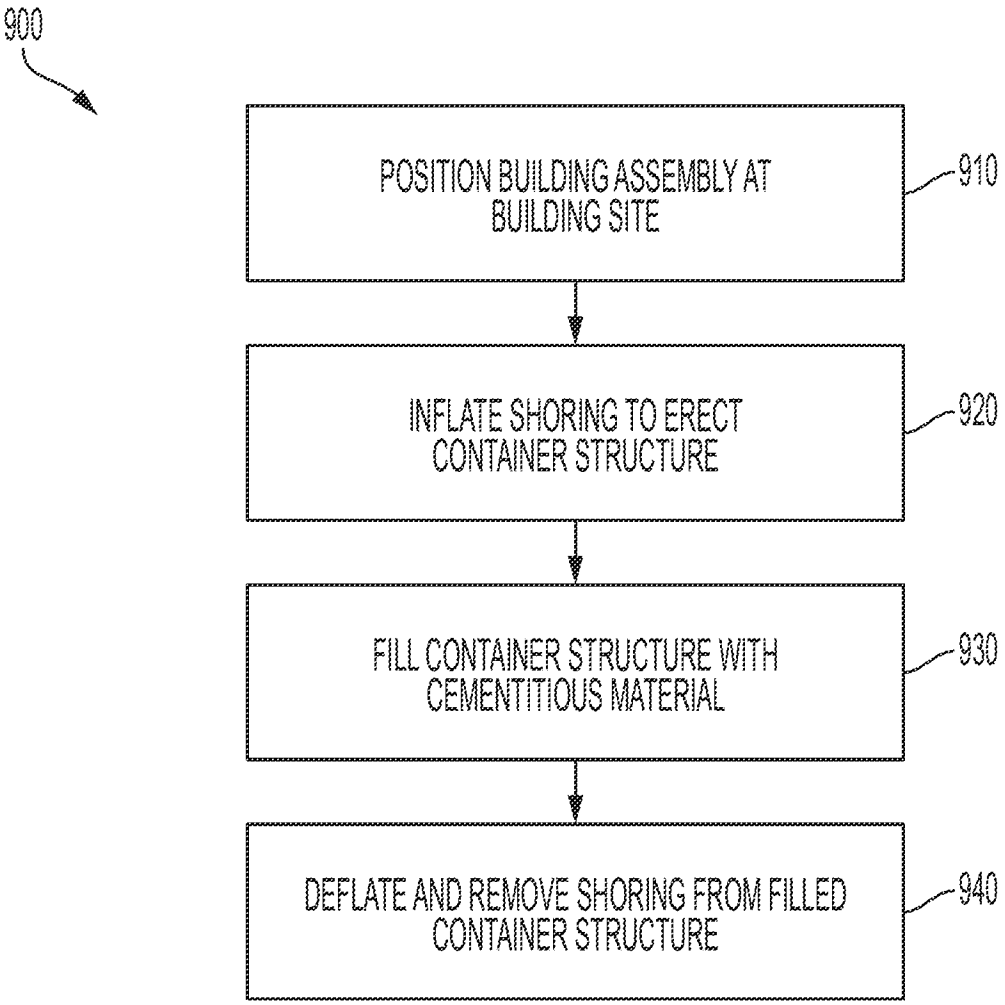
FIG. 9 is a flow diagram illustrating a method of constructing a building structure using the building structure assembly.

Various processes utilize the building assemblies described herein when forming structures, such as structures having vertical or raised sections (e.g., roofs, ceilings, support beams, and so on). FIG. 9 is a flow diagram illustrating an example method 900 of constructing a building structure using the building structure assemblies described herein.

In operation 910, a building assembly is positioned at a building site. As described herein, the building assembly can include a container structure having an expandable shape that is configured to be filled with a building material, and a removable shoring structure that supports the container structure when the container structure is filled with the building material. The building assembly can be placed on a foundation or other suitable area or location, depending on the size of the structure, weight of the structure, and/or movability of the structure.

In operation 920, the shoring structure is expanded to position the container structure in a desired shape. For example, the shoring structure is expanded or inflated by flowing air or other similar gases (e.g., Nitrogen) into the inside of the shoring structure, which expands and supports the container structure into a desired configuration. In some cases, the shoring structure is approximately the size of the container structure. However, in other cases, the shoring structure can be slightly larger or slightly smaller than the container structure (e.g., the surface area in contact with the container structure can be smaller, larger, or approximately equal).

In other cases, the building assembly can include multiple distinct shoring structures, each positioned to support a portion of the container structure. For example, a large structure, formed of a large, single container structure, can be supported by multiple shoring structures, in order to limit the energy utilized when inflating a similarly large shoring structure.

In operation 930, the container structure is filled (or caused to be filled) with the building material. For example, when the container structure is supported, the inside is pressurized, and cementitious material is injected into the inside of the container structure. Once the cementitious material hardens, the container structure is rigid and takes on its target form (e.g., walls, roof, floor).

In operation 940, the shoring structure is removed from the building assembly. Once the container structure is self-supporting (e.g., the cement or concrete has hardened), the shoring structure is deflated and can be removed from the assembly, leaving a standing, rigid, structure formed of concrete or cement (and one or more outer layers, including the drop stitch material). As described herein, the structure can be multi-layered, and include the following configurations:

an inner layer formed of a drop stitch material and configured to form the desired shape; a middle layer formed of an insulating material and configured to insulate the structure; and an outer layer formed of a façade material and configured to provide an outer façade for the structure;

a first layer formed of a drop stitch material and configured to form the desired shape; and a second layer formed of an insulating material and configured to insulate the structure;

a first layer formed of a drop stitch material and configured to form the desired shape; and a second layer formed of a covering material and configured to provide an outer façade of the structure;

a first layer formed of a drop stitch material and configured to form the desired shape; and a protection layer (e.g., an insulating layer, a waterproof layer, a fire-retardant layer); and so on.

Figure 10:
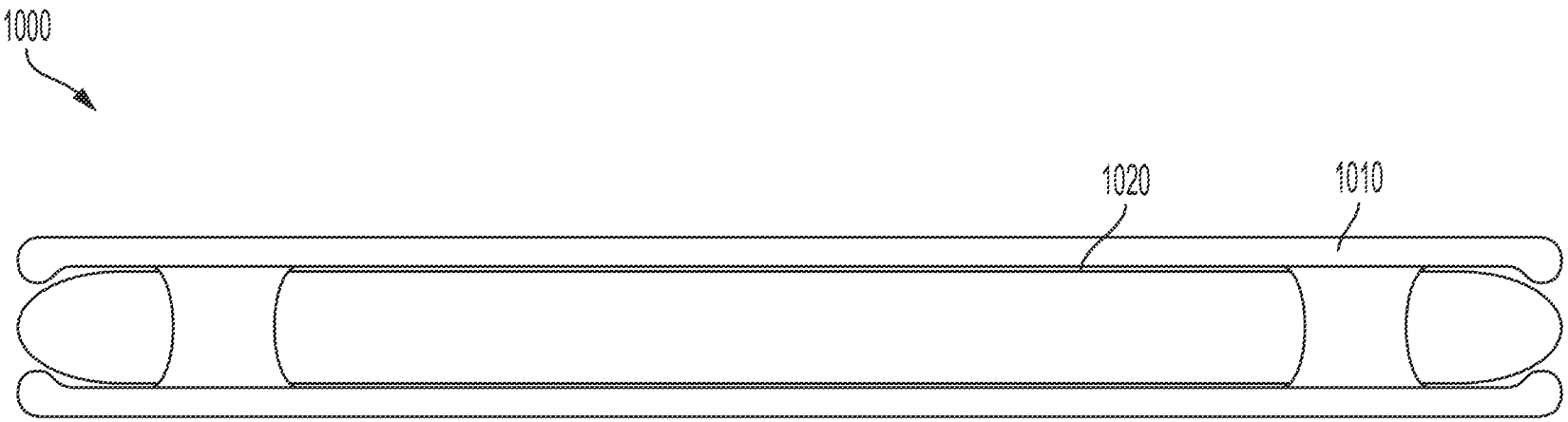
FIG. 10 is a diagram illustrating the building structure assembly in an unfilled form.

Thus, various processes can include and/or utilize the building assemblies described herein. A building assembly, therefore, can be provided as a single, unfilled apparatus, configurable in size, dimensions, shape, or geometry. FIG. 10 is a diagram illustrating a building structure assembly 1000 in an unfilled form.

The unfilled building assembly 1000 includes an expandable container 1010 formed of a drop stitch material and configured to be filled with a cementitious material, and an inflatable, removable, support structure 1020 (e.g., a shoring structure) configured to support the expandable container 1010 (or a portion thereof) in a vertical direction when the expandable container 1010 is filled of the cementitious material.

As described herein, the building assemblies facilitate the filling of cementitious materials into container structures in order to form structures. However, the building assemblies can utilize other flowable or fillable building materials that can later set or harden, including plastic foam, soil cement, cement bonded wood fiber, green concrete, fly ash, ashcrete, blast furnace slag, micron silica, composite concrete, and other alternatives or combinations, including mixtures of cement and supplementary cementitious materials (SCMs).

Further, while the building assemblies have been described for use in erecting building, the assemblies can be utilized to create or form other structures having vertical or other raised sections or aspects to be supported during formation. For example, all sorts of shelters or roofed structures can utilize the building assemblies, as well as large or tall structures that may benefit from assistance or support from a shoring structure during their formation. Thus, processes that may benefit from the support of hollow fillable forms when being erected can utilize the technology described herein.

CONCLUSION

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description using the singular or plural number may also include the plural or singular number respectively. The word "or", in reference to a list of two or more items, covers all of the following interpretations of the word: any of the items in the list, all of the items in the list, and any combination of the items in the list.

The above detailed description of embodiments of the disclosure is not intended to be exhaustive or to limit the teachings to the precise form disclosed above. While specific embodiments of, and examples for, the disclosure are described above for illustrative purposes, various equivalent modifications are possible within the scope of the disclosure, as those skilled in the relevant art will recognize.

The teachings of the disclosure provided herein can be applied to other systems, not necessarily the system described above. The elements and acts of the various embodiments described above can be combined to provide further embodiments.

Any patents and applications and other references noted above, including any that may be listed in accompanying filing papers, are incorporated herein by reference. Aspects of the disclosure can be modified, if necessary, to employ the systems, functions, and concepts of the various references described above to provide yet further embodiments of the disclosure.

These and other changes can be made to the disclosure in light of the above Detailed Description. While the above description describes certain embodiments of the disclosure, and describes the best mode contemplated, no matter how detailed the above appears in text, the teachings can be practiced in many ways. Details of the assembly and associated processes may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features, or aspects of the disclosure with which that terminology is associated. In general, the terms used in the following claims should not be construed to limit the disclosure to the specific embodiments disclosed in the specification, unless the above Detailed Description section explicitly defines such terms. Accordingly, the actual scope of the disclosure encompasses not only the disclosed embodiments, but also all equivalent ways of practicing or implementing the disclosure under the claims.

From the foregoing, it will be appreciated that specific embodiments have been described herein for purposes of illustration, but that various modifications may be made without deviating from the spirit and scope of the embodiments. Accordingly, the embodiments are not limited except as by the appended claims.

What is claimed is:

1. A building assembly for use in constructing a building, the building assembly comprising:

a container structure having an expandable shape including a roof, multiple support posts, and a floor, wherein the container structure is configured to be filled with a building material, and wherein the container structure is formed of a drop stitch material; and a removable, inflatable shoring structure that supports the container structure in a vertical direction and is disposed between the roof, the multiple support posts, and the floor, wherein the shoring structure is configured to be inflated to support the container structure in the vertical direction when the container structure is in the expandable shape and being filled with the building material; and wherein the shoring structure is configured to be deflated and removed when the building material in the container structure is hardened.

2. The building assembly of claim 1, wherein the container structure includes reinforcement components, separate from the shoring structure, disposed inside of the container structure, wherein the reinforcement components are positioned into a fixed configuration when the container structure is supported by the shoring structure and is filled with the building material, and wherein the reinforcement components include reinforcing cables or rebar.

3. The building assembly of claim 1, wherein the building material that fills the container structure includes cement or concrete.

4. The building assembly of claim 1, wherein the building material that fills the container structure includes a cementitious material.

5. The building assembly of claim 1, wherein the container structure is a multi-layered structure that includes:

an inner layer formed of the drop stitch material and configured to form the expandable shape;

a middle layer formed of an insulating material and configured to insulate the building; and an outer layer formed of a façade material and configured to provide an outer façade of the building.

6. The building assembly of claim 1, wherein the container structure is a multi-layered structure that includes:

a first layer formed of the drop stitch material and configured to form the expandable shape; and a second layer formed of an insulating material and configured to insulate the building.

7. The building assembly of claim 1, wherein the container structure is a multi-layered structure that includes:

a first layer formed of the drop stitch material and configured to form the expandable shape;

a second layer formed of a covering material and configured to provide an outer façade of the building.

8. The building assembly of claim 1, wherein the shoring structure is formed of an airtight fabric and configured to be inflated with air.

9. The building assembly of claim 1, wherein a section associated with the floor of the container structure includes a layer disposed below the container structure and configured to contact a foundation of the building.

10. The building assembly of claim 1, wherein a section associated with the floor of the container structure includes a layer disposed below the container structure and configured to contact another container structure when the building includes multiple stories.

11. A method of erecting a structure, the method comprising:

positioning a building assembly at a building site, wherein the building assembly includes:

a container structure having an expandable shape that is configured to be filled with a building material, wherein the container structure includes a roof, multiple support posts, and a floor, and an inflatable shoring structure that supports the container structure when the container structure is filled with the building material and is disposed between the roof, multiple support posts, and the floor;

expanding the shoring structure to position the container structure in a desired shape and support the container structure in a vertical direction;

causing the container structure to be filled with the building material; and removing the shoring structure from the building assembly.

12. The method of claim 11, wherein expanding the shoring structure to position the container structure in a desired shape includes inflating the shoring structure within the container structure in order to support the container structure in the desired shape.

13. The method of claim 11, wherein the container structure is formed of a drop stitch material.

14. The method of claim 11, wherein the container structure is a multi-layered structure that includes:

an inner layer formed of a drop stitch material and configured to form the desired shape;

a middle layer formed of an insulating material and configured to insulate the structure; and an outer layer formed of a façade material and configured to provide an outer façade for the structure.

15. The method of claim 11, wherein the container structure is a multi-layered structure that includes:

a first layer formed of a drop stitch material and configured to form the desired shape; and a second layer formed of an insulating material and configured to insulate the structure.

16. The method of claim 11, wherein the container structure is a multi-layered structure that includes:

a first layer formed of a drop stitch material and configured to form the desired shape;

a second layer formed of a covering material and configured to provide an outer façade of the structure.

17. The method of claim 11, wherein expanding the shoring structure to position the container structure in a desired shape includes expanding the shoring structure such that a roof portion of the container structure moves upwards with respect to a floor portion of the container structure.

18. An apparatus for forming a structure, the apparatus comprising:

an expandable container formed of a drop stitch material having fibers configured to be tensioned and configured to be filled with a cementitious material; and multiple reinforcing cables disposed inside the expandable container, wherein the reinforcing cables are positioned into a fixed configuration through the expandable container when the expandable container is filled with the cementitious material.

19. The apparatus of claim 18, further comprising:

an inflatable support structure configured to support at least a portion of the expandable container in a vertical direction when the expandable container is filled of the cementitious material.

20. The apparatus of claim 18, wherein the reinforcing cables extend through and at least partially out of the expandable container; and wherein the reinforcing cables extend in an orientation different that an orientation of the fibers of the drop stitch material.

* * * * *